US005124872A

United States Patent [19]

Pham et al.

[11] Patent Number: 5,124,872

[45] Date of Patent: Jun. 23, 1992

[54] HIGH TENSION CIRCUIT BREAKER HAVING VARISTORS

[75] Inventors: Van Doan Pham; Joseph Martin, both of Meyzieu; Robert Deville, Lyons, all of France

[73] Assignee: GEC Alsthom SA, Paris, France

[21] Appl. No.: 618,206

[22] Filed: Nov. 21, 1990

[30] Foreign Application Priority Data

Nov. 29, 1989 [FR] France ..... 89 15713

[51] Int. Cl.[5] ..... H01H 9/30

[52] U.S. Cl. ..... 361/11; 361/13; 361/58; 361/115; 361/132

[58] Field of Search ..... 361/120, 127, 117, 116, 361/132, 11, 126, 128, 115, 131, 58, 13; 338/21

[56] References Cited

FOREIGN PATENT DOCUMENTS

| | | |
|---|---|---|
| 0117914 | 9/1984 | European Pat. Off. . |
| 1424922 | 12/1965 | France . |
| 2512267 | 3/1983 | France . |
| 565410 | 11/1944 | United Kingdom . |
| 1112745 | 5/1968 | United Kingdom . |

*Primary Examiner*—Todd E. DeBoer

*Attorney, Agent, or Firm*—Sughrue, Mion, Zinn, Macpeak & Seas

[57] ABSTRACT

A high tension circuit breaker comprising at least one circuit-breaking chamber and, in parallel with the circuit-breaking chamber, firstly a varistor in series with an interrupter, and secondly a tension-distributing capacitor. The circuit breaker has a linear resistor having a resistance lying in the range range 30 ohms to 300 ohms inserted in series with the varistor. The invention is particularly suitable for reactance circuit breakers.

8 Claims, 4 Drawing Sheets

HIGH TENSION CIRCUIT BREAKER HAVING VARISTORS

The present invention relates to a high tension circuit breaker having varistors.

BACKGROUND OF THE INVENTION

High tension circuit breakers fitted with varistors are known, particularly for switching shunt reactances in electricity grids. The purpose of having varistors, also referred to as "non-linear resistors" or as "variable resistors" or as "voltage-dependent resistors", is to reduce surges.

The lower the operating threshold of a varistor, the more effective the protection it provides against surges. The higher the surge, the greater the energy that is absorbed by the varistor.

The desired surge limit is often of the order of 1.5 p.u. to 1.6 p.u.

For line circuit breakers fitted with varistors, there is a major problem that needs to be considered: firstly it is desirable to fix the surge threshold at 1.5 p.u., and secondly, in phase opposition, surge may reach 2 p.u. to 2.5 p.u.

Proposals have been made to connect an interrupter in series with the varistor in order to avoid applying too high a tension to the varistor. However, in spite of this disposition, the varistor remains the seat of excessive energy dissipation. Consider phase opposition by way of example. On circuit breaking: a tension of about 2 p.u. is applied to the varistors for one period (at 50 Hz or at 60 Hz) before the arc is finally extinguished on the contacts of the interrupter.

At a tension of 2 p.u., the current may reach a high value. For example:

at 1 p.u. the current may be 5/10,000 amps;

at 1.5 p.u. the current may be 1 amp; and at 2 p.u. the current may exceed 2,000 amps.

Since the voltage in the range 1.5 p.u. to 2 p.u. may be applied for a duration of several milliseconds, the energy dissipated in the varistors may reach several thousand kilojoules.

It is necessary to reduce this energy while still ensuring proper operation at 1.5 p.u.

The varistors may also be subjected to thermal overload in the event of tension being conveyed to the terminals of a multiple chamber circuit breaker by partial arcing when circuit breaking on a fault or on an empty line.

An object of the present invention is to provide a high tension circuit breaker having varistors and providing a solution to this problem.

SUMMARY OF THE INVENTION

The present invention provides a high tension circuit breaker comprising at least one circuit-breaking chamber and, in parallel with said circuit-breaking chamber, firstly a varistor in series with an interrupter, and secondly a tension-distributing capacitor, wherein a linear resistor having a resistance lying in the range 30 ohms to 300 ohms is inserted in series with said varistor.

In a particular embodiment, the resistor is constituted by a first stack of disks disposed in an insulating tube in which the varistor is placed in the form of a second stack of disks, said tube being placed inside an insulating column filled with a gas having good dielectrical properties.

In a variant, said resistor is in the form of a stack of disks placed in an insulating tube, said tube being disposed horizontally and being mechanically and electrically connected at one end to a column containing the main circuit-breaking chamber and at its other end to a column containing the varistor.

In another variant, the varistor and the resistor constituted by sticks are housed side by side in an insulating casing which surmounts the main circuit-breaking chamber.

In another variant, the varistor is disposed in a column provided with a lid having a horizontal extension containing the associated resistor, the extension being closed by an end provided with a current terminal.

Advantageously, the lid having an extension containing the resistor surmounts the main circuit-breaking chamber.

The varistors are made of a substance selected from silicon carbide and compounds based on zinc oxides.

BRIEF DESCRIPTION OF THE DRAWINGS

Embodiments of the invention are described by way of example with reference to the accompanying drawings, in which.

DETAILED DESCRIPTION

Figure 1:
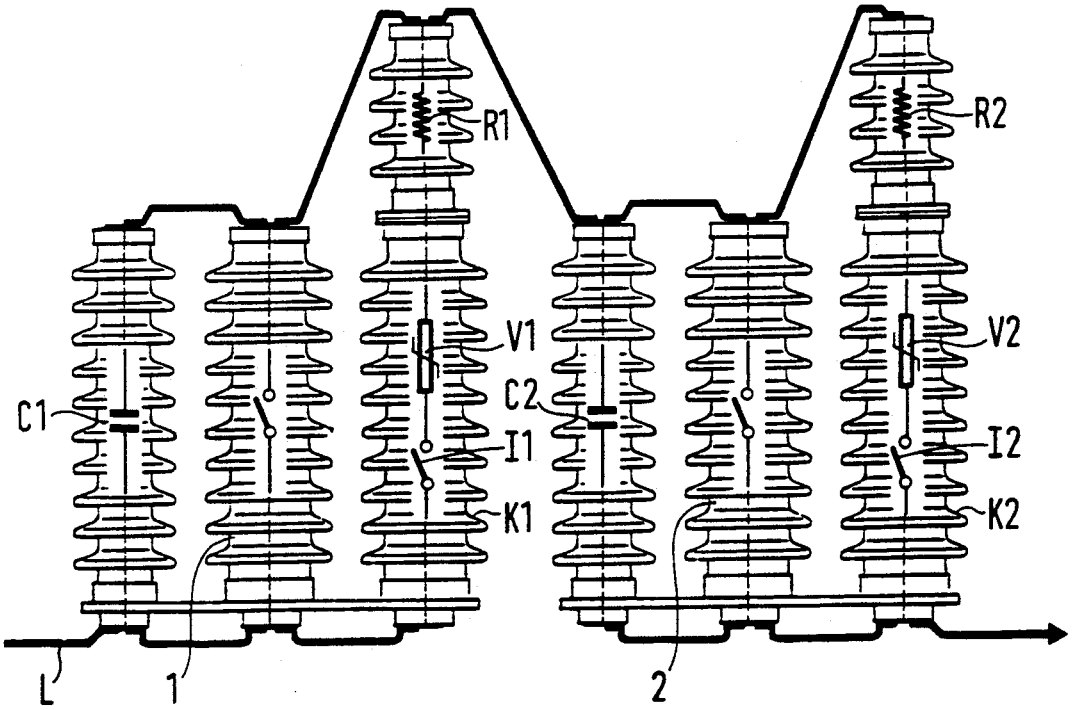
FIG. 1 is a circuit diagram of a circuit breaker of the invention having two circuit-breaking chambers.

In FIG. 1, reference L designates a phase of a high tension line in which a circuit breaker is inserted, said circuit breaker comprising two-series connected circuit-breaking chambers 1 and 2 for each of the phases. In order to simplify the drawing, the supports of the circuit-breaking chambers and their drive mechanisms are not shown. In well known manner, each circuit-breaking chamber is constituted by an insulating column filled with a gas having high dielectric strength, such as sulfur hexafluoride, at a pressure of a few bars.

Each of the circuit-breaking chambers has a respective insulating column C1 and C2 disposed in parallel therewith. These columns contain a dielectric gas or liquid and they house respective capacitors for the purpose of sharing the tension between the two circuit-breaking chambers.

Each chamber includes another column in parallel therewith, respectively referenced K1 or K2, with each of the other columns containing a series connection of a varistor (V1, V2) and an interrupter (I1, I2).

According to the main characteristic of the invention, each of these columns K1 and K2 further includes an additional resistor (R1, R2) connected in series therewith.

An example of how to calculate the resistance of such an additional resistor R1, R2 is shown below. The resistors R1 and R2 have the same resistance, and their total resistance is written Ra.

It is desired that for a surge U equal to 2 p.u., the current flowing through the varistor should not exceed a threshold value Is.

This threshold value Is corresponds to a threshold voltage Us for the varistor. The internal resistance of the varistor at the threshold is:

$$Rs = Us/Is$$

If the additional resistance that serves to limit the current to Is is written Ra, then, neglecting circuit impedance, the following equation is applicable:

$$U = Is\,(Ra + Rs)$$

Consider a numerical worked example:

U = 900 kV peak
Is = 700 A peak
Us = 845 kV peak
Rs = 1207 ohms

From this it can be deduced that Ra = 80 ohms, such that each resistor R1 and R2 has a resistance of 40 ohms.

While passing a current of 700 A peak, the voltage across each resistor is 28,000 V peak.

The total duration of 700 A peak in phase opposition can be estimated at 6 milliseconds.

These considerations make it possible to determine the dimensions of the resistors R1 and R2 which, generally speaking, have resistances lying in the range 30 ohms to 300 ohms.

Returning to the above example, the heat energy dissipated by a resistor while operating in phase opposition will be about:

$$(40 \times 700^2 \times 6 \times 10^{-3})/2,$$

i.e. about 60,000 joules.

In the event of a short temporary surge (as occurs when interrupting a short circuit, or when tension is transferred), exceeding 2 p.u. or exceeding the threshold voltage of a varistor, the presence of the additional resistance Ra is effective in reducing the current to a value which is acceptable for a short duration, e.g. 1,500 amps for a short period at 2.4 p.u. The voltage across the terminals of each resistor R1 and R2 is then 60,000 V peak.

At the end of the opening strokes of the interrupters I1 and I2, the varistors V1 and V2 are completely isolated from the circuit.

It may be observed that using additional resistors is not good for protection of phase-to-ground faults. When lightening strikes the line, the presence of the additional resistors prevents charge escaping quickly. Given the large magnitude of the discharge current (which may reach about 10 kiloamps), and given the high rate at which the current increases, a high surge then occurs across the resistor.

It should be observed that in order to avoid a major drop in tension at the moment tension is transferred, which would give rise to a high frequency, it is necessary for the connection between the resistor and the varistor to be as short as possible.

Several embodiments of the invention are now described.

Figure 2:
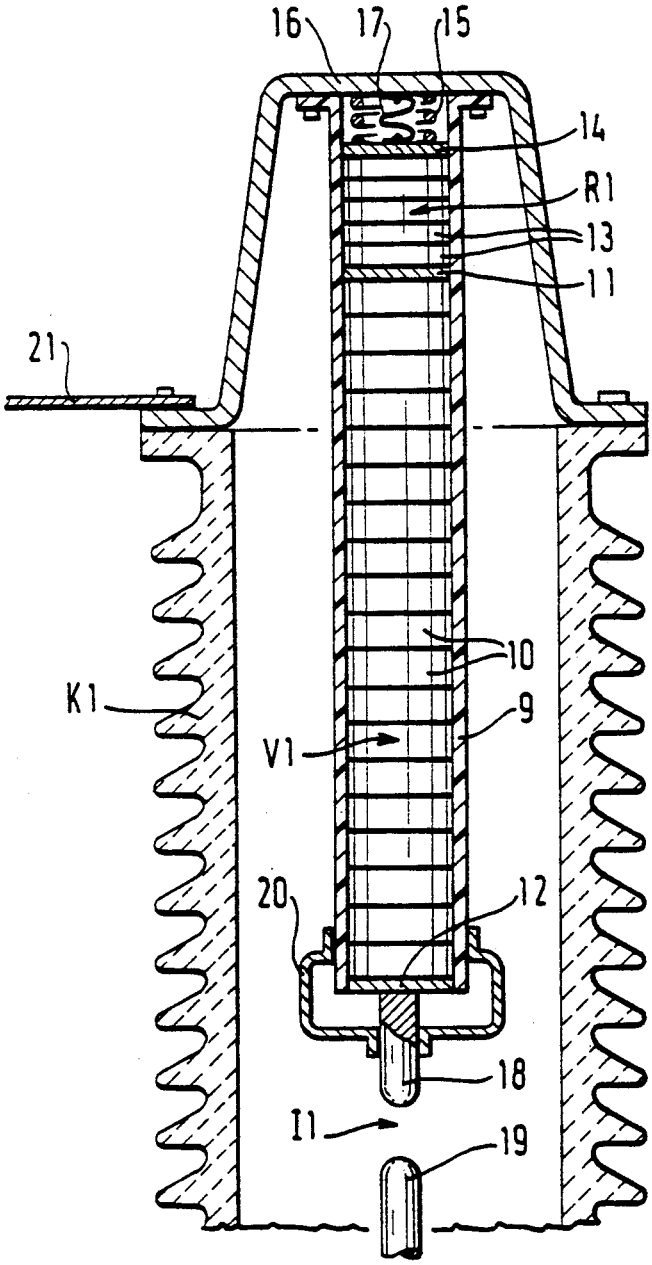
FIG. 2 is a fragmentary view in axial section of an insulating column containing a varistor and its associated resistor.

FIG. 2 is a fragmentary axial section through the column K1 containing the varistor V1 and the resistor R1.

A tube 9 of insulating material is disposed inside the ceramic column K1 and contains the varistor V1 and the resistor R1.

The varistor V1 is made up of a stack of disks 10 based on zinc oxides or on silicon carbide (SiC), and the top and bottom of the stack are closed by respective metal disks 11 and 12.

The resistor R1 is constituted by a stack of disks 13 e.g. made of a carbon-based conducting ceramic. The stack is placed directly above the metal disk 11 and its top end is in contact with a metal disk 14. A spring 15 presses the disk 14 against the stack R1 and bears against the inside of a metal cap 16 which closes the column K1. A metal braid 17 allows current to flow between the cap 16 and the disk 14.

Reference 18 designates the fixed contact of interrupter I1, while reference 19 designates the end of the moving contact. Since the design of such an interrupter is well known and lies outside the scope of the present invention, the interrupter is not shown in detail. A metal cap 20 surrounds the end of the tube 9 and a portion of the fixed contact 18 and serves to smooth out equipotential curves in this zone.

The cap 16 is electrically connected by a connection 21 to the top of the main circuit-breaking chamber 1 (not shown in FIG. 2, but shown diagrammatically in FIG. 1).

The inside of the column K1 is filled with a gas having good dielectric properties that enhance circuit breaking, e.g. pure or mixed sulfur hexafluoride under a pressure of a few bars.

Figure 3:
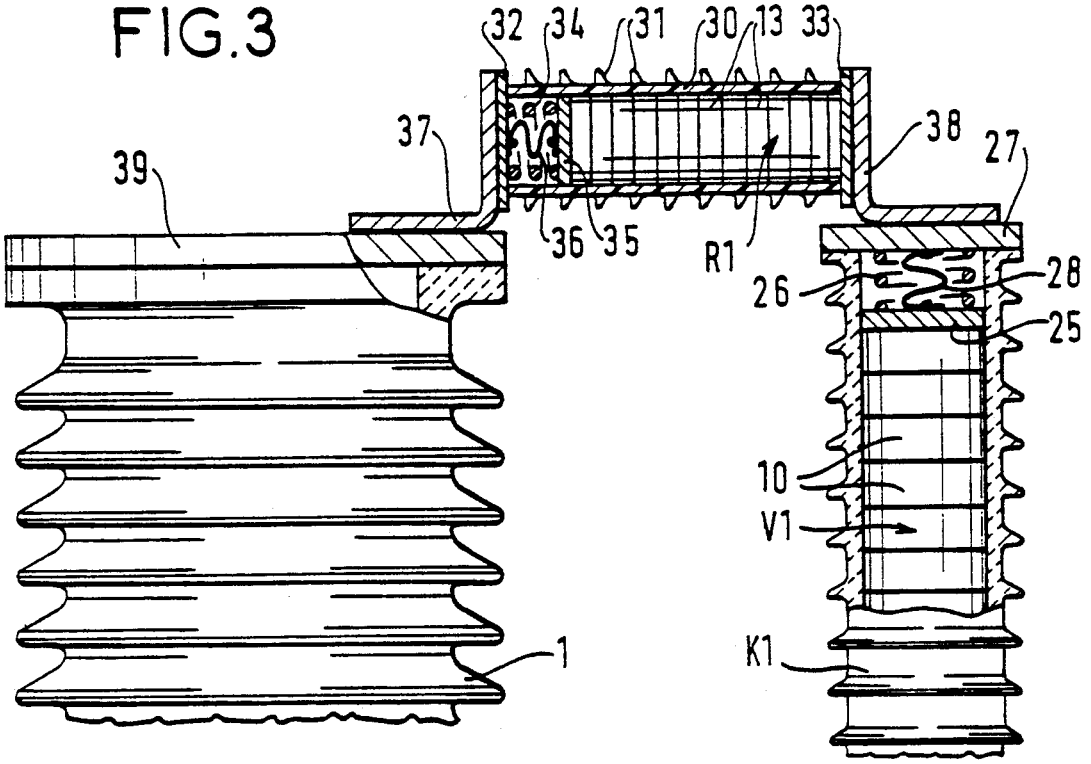
FIG. 3 is a fragmentary axial section through an insulating column containing a varistor, with the associated resistor being placed inside said column and with the column containing the main circuit-breaking chamber.

FIG. 3 shows a portion of column 1 and of column K1, and in this case the resistor R1 is disposed outside both of these columns.

The varistor V1 is still constituted by a stack of disks 10 surmounted by a metal disk 25 pressed down by a spring 18 which bears against a metal lid 27 closing the column K1. A metal braid 28 between the disks 25 and the lid 27 serves to pass current.

The resistor R1 is constituted by a stack of disks 13 placed in an insulating tube 30, e.g. made of epoxy glass, and possibly provided with fins 31, e.g. made of silicone.

The tube 30 is hermetically sealed at both ends by metal plates 32 and 33. The disks 13 are pressed by a spring 34 which bears against plate 32 and a metal disk 35 at the end of the stack. A metal braid 36 passes current between the braid 32 and the disk 35.

The tube 30 is disposed horizontally between column 1 and column K1 and it is connected both mechanically and electrically thereto. To do this, connections 37 and 38 serve respectively to connect the plate 32 to the metal top 39 of column 1, and the plate 33 to the lid 27.

Resistor R1 passes current only for a very short period of time. In both the "open" and the "closed" positions of the circuit breaker, the connections 37 and 38 are at the same potential. There is thus no permanent tension across the resistor R1.

Under such conditions, there is no reason why synthetic insulating substances should not be used.

The disks 13 may make up a single block and may be closed by molding inside a synthetic envelope.

Figure 4:
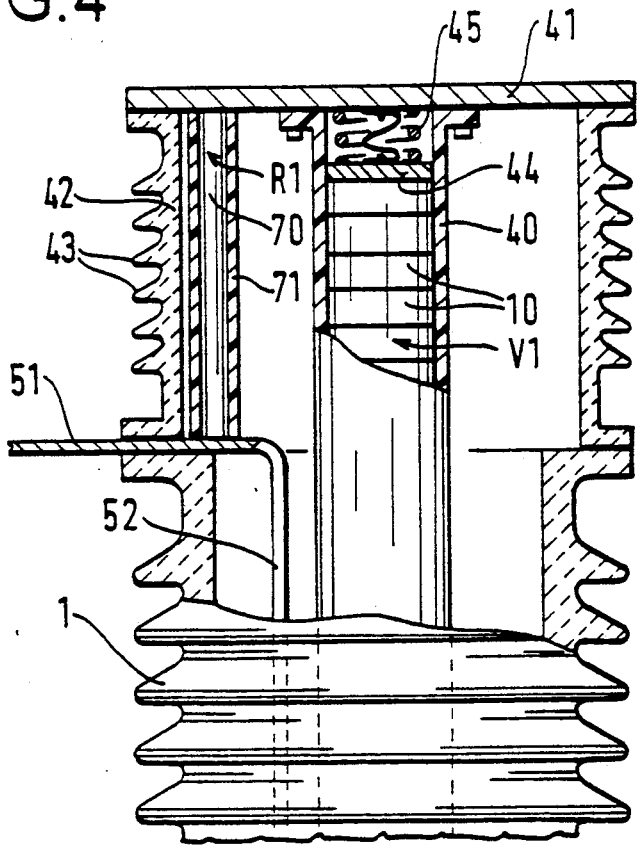
FIG. 4 is a fragmentary diagrammatic section through a different embodiment in which the varistor and the resistor are disposed side by side in the same insulating column.

FIG. 4 shows a variant embodiment in which the varistor V1 and resistor R1 are housed inside a column 1 containing the main circuit-breaking chamber.

The varistor V1 is constituted by a stack of disks 10 placed in a tube 40 fixed to the lid 41 of the column 1. This lid is placed at the top of an insulating cylindrical casing 42 provided with fins 43, this casing extends above the column 1 and may be made of porcelain or of synthetic insulating material.

As before, the stack of disks 10 is surmounted by a metal disk 44 against which a spring 45 bears whose other end bears against the lid 41.

The bottom portion of the tube 40 (not shown) serves as a support for the semifixed varistor-insertion contact, as described, for example, in French patent number 81 16 291.

Resistor R1 is made up of one or more small diameter sticks 70 based on carbon (ceramic resistances) housed in insulating tubes 71 and fixed between the lid 41 and the current terminal 51 for the circuit-breaking chamber. The number of sticks depends on the amount of energy to be absorbed.

Reference 52 designates the fixed contact tube for carrying current on a permanent basis.

Figure 5:
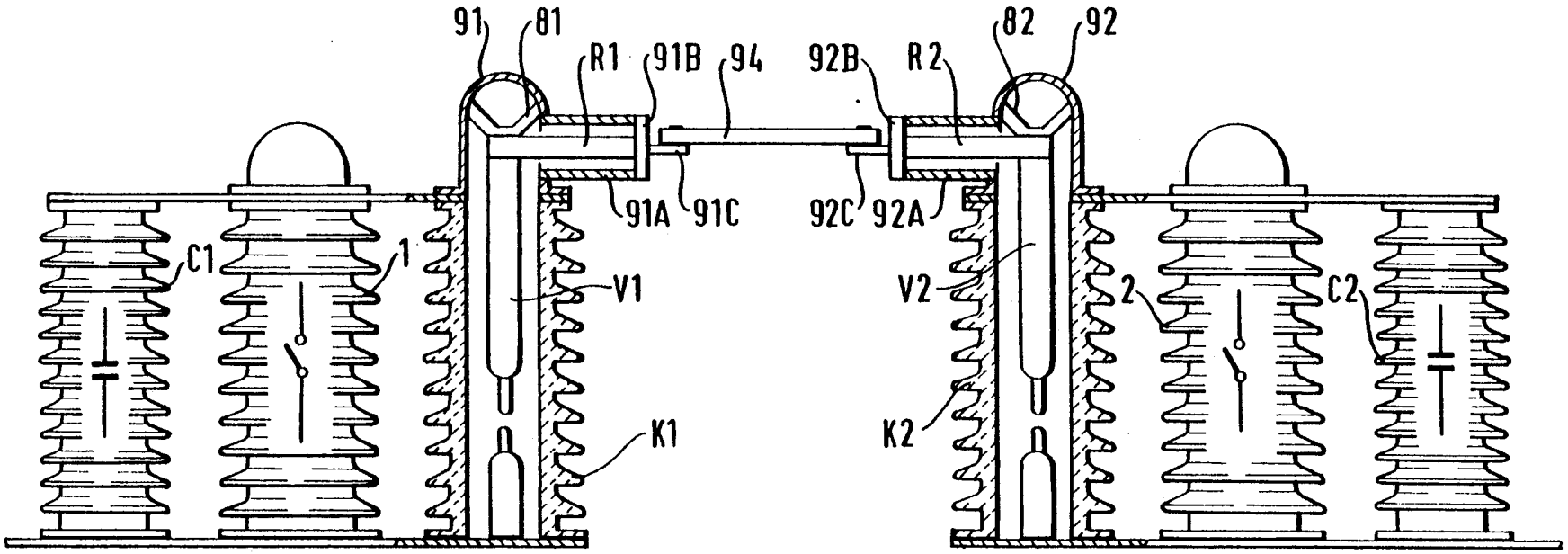
FIG. 5 is a diagrammatic view of a circuit breaker having two circuit-breaking chambers in series, and in which the resistor associated with one of the varistors is disposed in an extension of the cover of the column containing said varistor.

FIG. 5 shows another embodiment of the invention for a circuit breaker having two circuit-breaking chambers per phase. Items which are common to FIG. 5 and FIG. 1 are given the same reference numbers or symbols.

The varistors V1 and V2 are disposed in respective ones of the columns K1 and K2. They are held in place by insulating supports 81 and 82 fixed to metal lids 91 and 92 surmounting the columns K1 and K2.

The metal lids 91 and 92 have horizontal cylindrical extensions 91A and 92A housing the resistors R1 and R2, respectively. The resistors R1 and R2 are fixed firstly to the supports 81 and 82 and secondly to the metal ends 91B and 92B closing the cylinders 91A and 92A. The ends 91B and 92B have current terminals 91C and 92C which are interconnected by a connection tube 94 for connecting the two circuit-breaking chambers 1 and 2 in series.

The columns K1 and K2 and the cylindrical extensions of the lids constitute gastight assemblies which are filled with a dielectric gas. The varistor-resistor pairs V1 and R1 and V2 and R2 are thus in the same dielectric fluid.

Naturally, the lid 91 with its horizontal cylindrical extension 91A could equally well be mounted on the insulating column 1 of the main circuit-breaking chamber.

The invention is not limited to the embodiments described and shown. Without going beyond the scope of the invention, various means may be replaced by equivalent means.

The invention is applicable to high tension circuit breakers, and in particular to reactance circuit breakers.

We claim:

1. A high tension circuit breaker comprising: at least one circuit breaking chamber, and, electrically in parallel with said circuit breaking chamber, firstly a varistor in series with a linear resistor and an interrupter, and secondly a tension distributing capacitor, said linear resistor having a resistance lying in the range of 30 ohms to 300 ohms, said resistor being constituted by a first stack of disks disposed in an insulating tube further receiving the varistor in the form of a second stack of disks, and said tube being placed inside an insulating column filled with a gas having good dielectric properties.

2. A circuit breaker according to claim 1, wherein said varistor is made of a substance selected from the group consisting of silicon carbide and compounds based on zinc oxides.

3. A high tension circuit breaker comprising: at least one circuit breaker chamber, and, electrically in parallel with said circuit breaking chamber, firstly a varistor in series with a linear resistor and an interrupter, and secondly a tension distributing capacitor, said linear resistor having a resistance lying in the range of 30 ohms to 300 ohms, said resistor being in the form of a stack of disks placed in an insulating tube, said tube being disposed horizontally and being mechanically and electrically connected at one end to a column containing the main circuit breaking chamber and at another end to a column containing the varistor.

4. A circuit breaker according to claim 3, wherein said varistor is made of a substance selected from the group consisting of silicon carbide and compounds based on zinc oxides.

5. A high tension circuit breaker comprising: at least one circuit breaking chamber, and, electrically in parallel with said circuit breaking chamber, firstly a varistor in series with a linear resistor and an interrupter, and secondly a tension distributing capacitor, said linear resistor having a resistance lying in the range of 30 ohms to 300 ohms, and said varistor and said resistor being constituted by sticks housed side by side in an insulating casing which surmounts the main circuit breaking chamber.

6. A circuit breaker according to claim 5, wherein said varistor is made of a substance selected from the group consisting of silicon carbide and compounds based on zinc oxides.

7. A high tension circuit breaker comprising: at least one circuit breaking chamber, and, electrically in parallel with said circuit breaking chamber, firstly a varistor in series with a linear resistor and an interrupter, and secondly a tension distributing capacitor, said linear resistor having a resistance lying in the range of 30 ohms to 300 ohms, said varistor being disposed in a column provided with a lid having a horizontal extension containing said resistor, and said extension being closed by an end provided with a current terminal.

8. A circuit breaker according to claim 7, wherein said varistor is made of a substance selected from the group consisting of silicon carbide and compounds based on zinc oxides.

* * * * *